US005742031A

United States Patent [19]

Kelly et al.

[11] Patent Number: 5,742,031

[45] Date of Patent: Apr. 21, 1998

[54] METHOD AND APPARATUS FOR OPERATING A DOWNDRAFT COOKING VAPOR WITHDRAWAL SYSTEMS

[75] Inventors: Paul H. Kelly; Ranya C. Hibbler, both of Indianapolis, Ind.

[73] Assignee: Maytag Corporation, Newton, Iowa

[21] Appl. No.: 734,140

[22] Filed: Oct. 21, 1996

Related U.S. Application Data

[62] Division of Ser. No. 509,358, Jul. 31, 1995, Pat. No. 5,619,982.

[51] Int. Cl.[6] ..... H05B 3/68; F24C 15/20; F24C 3/00; A47J 29/02

[52] U.S. Cl. ..... 219/460; 126/299 D; 126/299 R; 126/39 R; 99/340

[58] Field of Search ..... 219/460, 757; 126/299 D, 299 R, 39 E, 39 R, 39 N, 39 M, 21 R; 99/340, 341; 454/67, 191

[56] References Cited

U.S. PATENT DOCUMENTS

| | | | |
|---|---|---|---|
| 3,162,237 | 12/1964 | Brown et al. | 158/99 |
| 3,169,871 | 2/1965 | Macchi et al. | 99/1 |
| 3,444,805 | 5/1969 | Happel et al. | 99/340 |
| 3,494,350 | 2/1970 | Perl | 126/39 |
| 3,587,555 | 6/1971 | Cerola | 126/299 D |
| 3,592,180 | 7/1971 | Kweller | 126/39 |
| 3,712,819 | 1/1973 | Field | 99/340 |
| 3,797,375 | 3/1974 | Cerola | 219/460 |
| 3,870,457 | 3/1975 | Perl | 431/66 |
| 3,968,785 | 7/1976 | Perl | 126/39 |
| 4,020,821 | 5/1977 | Reid, Jr. et al. | 126/39 |
| 4,042,806 | 8/1977 | McCartney | 219/460 |
| 4,409,954 | 10/1983 | Berlik et al. | 126/39 M |
| 4,413,610 | 11/1983 | Berlik | 126/39 K |
| 4,413,611 | 11/1983 | Berlik | 126/39 E |
| 4,431,892 | 2/1984 | White | 219/460 |
| 4,446,849 | 5/1984 | McFarland | 126/299 R |
| 4,457,293 | 7/1984 | Berlik | 126/39 N |
| 4,750,470 | 6/1988 | Beach et al. | 126/39 R |
| 4,886,046 | 12/1989 | Welch | 126/299 D |
| 5,042,458 | 8/1991 | Spencer et al. | 126/299 R |
| 5,190,026 | 3/1993 | Doty | 126/39 R |
| 5,209,217 | 5/1993 | Beach et al. | 126/39 R |
| 5,213,091 | 5/1993 | Beach | 126/299 R |
| 5,301,653 | 4/1994 | Gerdes et al. | 126/39 E |
| 5,619,982 | 4/1997 | Kelly et al. | 126/299 D |

FOREIGN PATENT DOCUMENTS

| | | | |
|---|---|---|---|
| 1443553 | 7/1976 | United Kingdom | F23D 13/00 |
| 1543618 | 4/1979 | United Kingdom | F23D 21/00 |

*Primary Examiner*—Teresa J. Walberg
*Assistant Examiner*—Sam Paik
*Attorney, Agent, or Firm*—Brinks Hofer Gilson & Lione

[57] ABSTRACT

A downdraft cooktop includes an electrical switch having a plurality of cooking rate selections, a vapor withdrawal opening formed in the cooktop adjacent a grill element, a vapor withdrawal duct below and in communication with the withdrawal opening and with a withdrawal fan, an electric motor for driving the withdrawal fan, and a fan control switch for varying rates of operation of the fan. The withdrawal fan is operable for downdraft withdrawal of cooking vapors resulting from operation of the grill element. Grill operation is sensed and during grill operation, the fan control switch is bypassed and the electrical fan motor is operated at a high rate for vapor withdrawal.

4 Claims, 3 Drawing Sheets

METHOD AND APPARATUS FOR OPERATING A DOWNDRAFT COOKING VAPOR WITHDRAWAL SYSTEMS

This application is a division of application Ser. No. 08/509,358, filed Jul. 31, 1995, now U.S. Pat. No. 5,619,982.

The present invention relates to cooktops in general and to cooktops with grills in particular. The invention further relates to cooktops with grills incorporating a downdraft feature using a fan to remove grease laden air from the cooking environment and, more particularly, to the method and apparatus for requiring high speed downdraft fan operation during grilling operations.

BACKGROUND OF THE INVENTION

Conventional cooktops are known to include a grill portion and a range top portion. Typically, the cooktop can include gas or electric burners and a grill element, along with associated controls. Some cooktops further include a downdraft feature whereby a downdraft fan pulls cooking odors and grease laden air downwardly through a grate in the cooktop and moves it, through ducting, from the kitchen to outside the home.

Typically the downdraft fans are multiple speed fans, having a low speed and a high speed. The fans are generally controlled by a multi-position switch or a potentiometer or rheostat to set the speed of the fan. For removal of normal cooking odors or steam or the like, low speed operation of the downdraft fan is typically adequate. However, when using the grill portion, a fan set at low speed has been unable to withdraw all of the grease laden air from the kitchen and duct it to the outside environment. In particular, experience has shown that a downdraft fan must move about 300 cubic feet of air per minute (cfm) in order to avoid grease accumulation in the ducting. At slower speeds, grease can accumulate, especially at elbows formed in the ducting. Eventually, the grease accumulation can begin to close off and restrict the air flow through the ducting, thereby reducing the effectiveness of the air removal fans, and cause other problems as well. Unfortunately, a cook can forget to set the fan at high speed. In some cases, the cook may intentionally operate the fan at low speed during grill operation, such as when a lower noise level may be desirable. Accordingly, it is desirable that a downdraft fan is always operated at high speed during grill operation regardless of the cook's selected operation of the fan.

SUMMARY OF THE INVENTION

The present invention automatically overrides the fan control switch and operates the fan at high speed whenever the grill portion is being used. In the invention, a downdraft cooktop includes an electrical switch having a plurality of cooking rate selections, a vapor withdrawal opening formed in the cooktop adjacent the grill element, a vapor withdrawal duct below and in communication with the withdrawal opening and with a withdrawal fan, an electric motor for driving the withdrawal fan, and a fan control switch for varying rates of operation of the fan. The withdrawal fan is operable for downdraft withdrawal of cooking vapors resulting from operation of the grill element. The invention further includes means for sensing the selection of grill operations and for bypassing the fan control switch and operating the electrical fan motor at a high rate for vapor withdrawal during grill operations.

The invention also includes an improved method of withdrawing cooking vapor from adjacent a cooktop in which a grill is operated. The cooking vapor is withdrawn downwardly from adjacent the cooktop by a motor-driven fan operable at high and low rates of withdrawal selected by a multi-position electrical control switch. The improvement to the method comprises sensing the selection of the grill for cooking operation, and bypassing the electrical control switch and connecting the motor driven fan for operation at only a high rate of withdrawal of cooking vapors. According to one aspect of the invention, upon sensing the de-selection of the grill, the electrical switch is not bypassed. In preferred methods, the grill comprises an electrical grill element, and the presence of the grill element is sensed.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE INVENTION

DETAILED DESCRIPTION OF THE INVENTION

Figure 1:
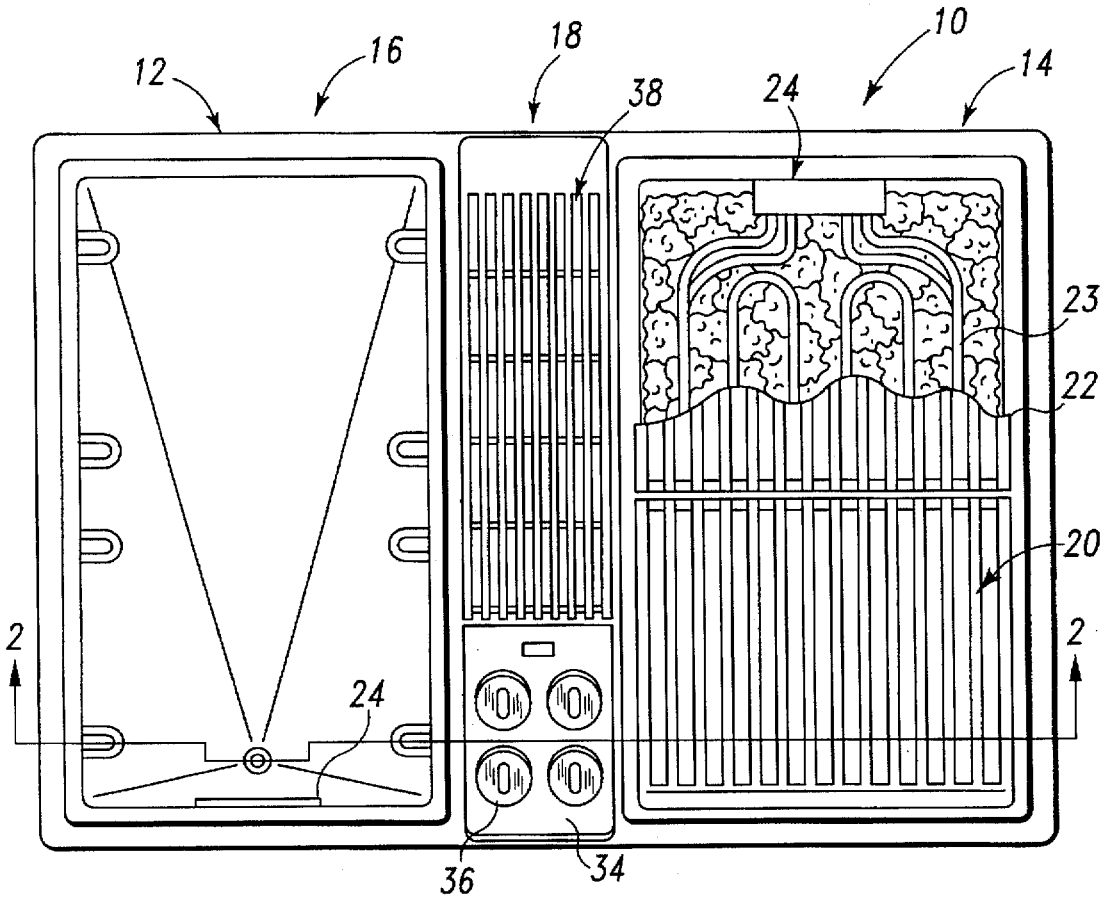
FIG. 1 is a plan view of the cooktop having left and right bays and a center panel with a grill element positioned in the right bay and having a grill heating element covered by a partially broken away grill grate.
Figure 2:
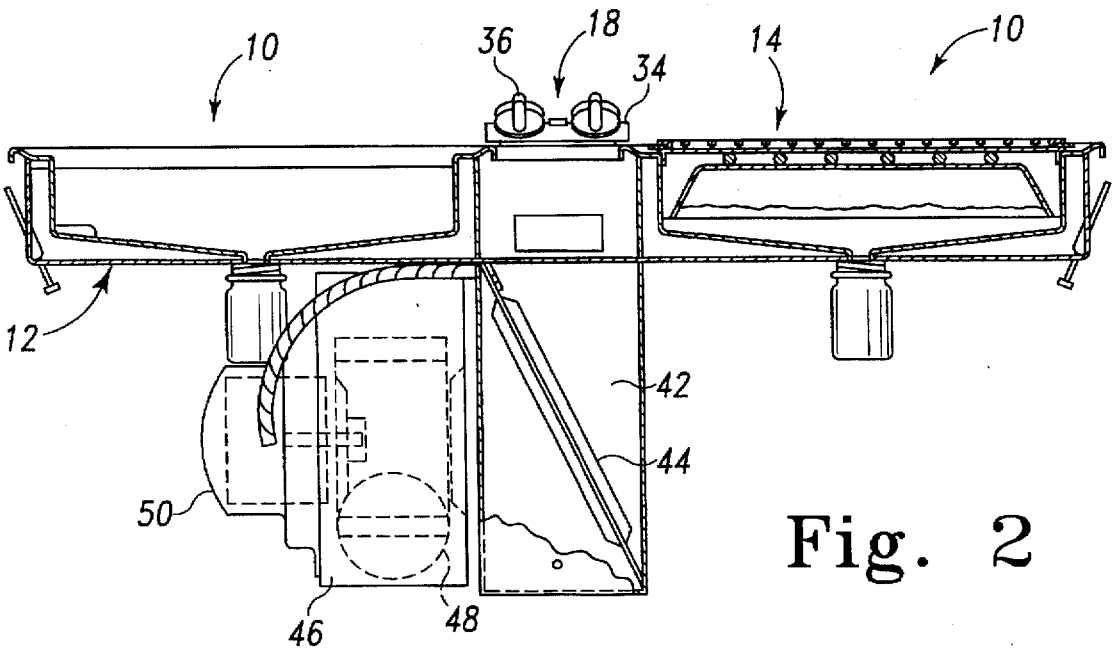
FIG. 2 is a side section view taken along lines 2—2 of FIG. 1.
Figure 3:
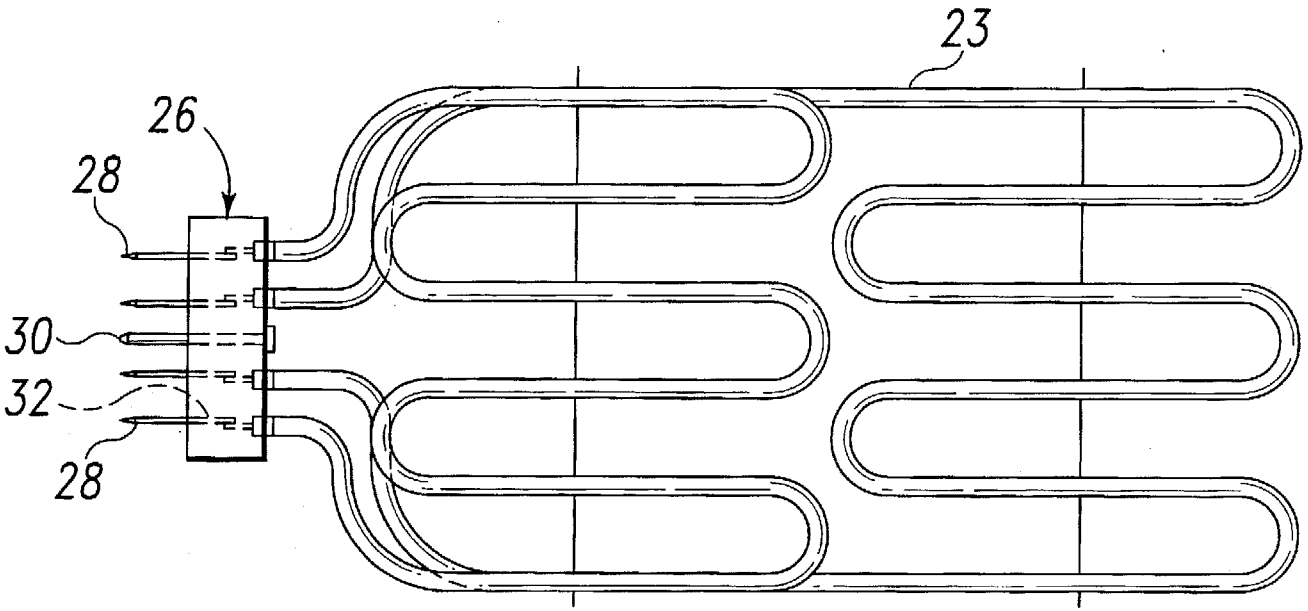
FIG. 3 is a plan view of a grill heating element for use with the grill element shown in FIG. 2.
Figure 4:
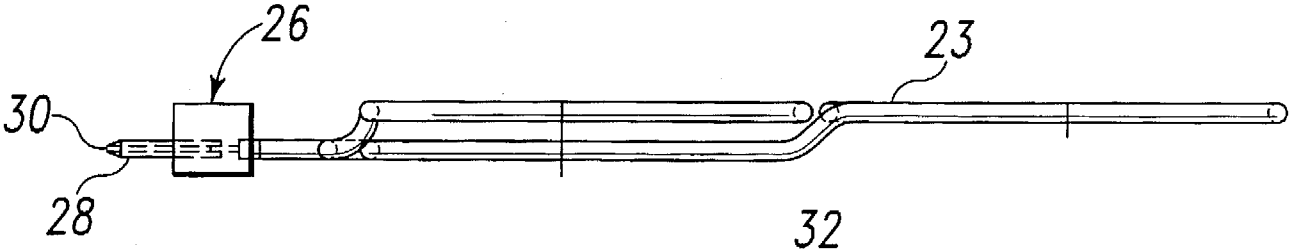
FIG. 4 is a side view of the grill heating element of FIG. 3.

A cooktop 10 for use with the present invention is illustrated in FIGS. 1 and 2. The cooktop 10 includes a burner box assembly 12 divided into a right bay 14, a left bay 16 and a center section 18 positioned therebetween. The right and left bays 14, 16 are formed to retain and support modular cooking elements 20, such as a grill element 22, shown partially broken away in the right bay 14 of FIG. 1, or a burner assembly (not shown). Each bay 14, 16 also includes a conventional female ceramic block connector 24 for electrically connecting the cooking elements 20 to the cooktop 10. The cooking elements 20, such as grill element 22, as shown in FIGS. 3 and 4, include a conventional male ceramic block connector 26 having a plurality of connector blades 28 for engaging receiving apertures in the female block connector 24 and a center locating/grounding pin 30 for aligning the male block connector 26 with the female block connector 24. The connector blocks engage in a fashion similar to a conventional electrical plug and wall outlet in a home.

Figure 5:
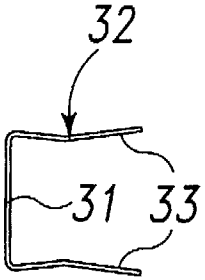
FIG. 5 is a shunt for use with the grill heating element of FIGS. 3 and 4.

The grill element 22 includes a grill heating element 23. A metal shunt 32, shown in FIG. 5, is installed between two adjacent connector blades 28 of the grill heating element 23. The shunt 32 is a single piece of metal, such as steel, bent to form a generally U-shaped piece having a base portion 31 and a pair of legs 33 extending perpendicular to the base portion 31. The base portion 31 extends between the adjacent connector blades 28 so as to position the legs 33 in contact with the adjacent connector blades 28, thereby providing an electrical short-circuit between the adjacent connector blades 28.

The center section 18 includes a control panel 34, with various cooking controls 36, and a withdrawal opening 38. The withdrawal opening 38 is connected to an air passage 42 which includes a filter 44 for filtering particulate matter from air drawn through the withdrawal opening 38. The air passage 42 is connected to a blower scroll 46, which in turn is connected to duct work 48 leading away from the blower scroll 46. A withdrawal fan 50 is mounted to the plenum 46 so as to draw air into the plenum 46 through the withdrawal opening 38, air passage 42 and filter 44, and move the air out of the kitchen through the duct work 48.

When the grill heating element 23 is being installed in one of the bays 14, 16 of the burner box assembly 12, the center locating/grounding pin 30 and the connector blades 28, with the shunt 32, are aligned with corresponding receiving apertures in the female block connector 24. As the grill heating element 23 is pushed into position in the bay 14, 16, the locating/grounding pin 30 and connector blades 28 fully engage the female block connector 24, providing electrical connection to the grill heating element 23.

Figure 6:
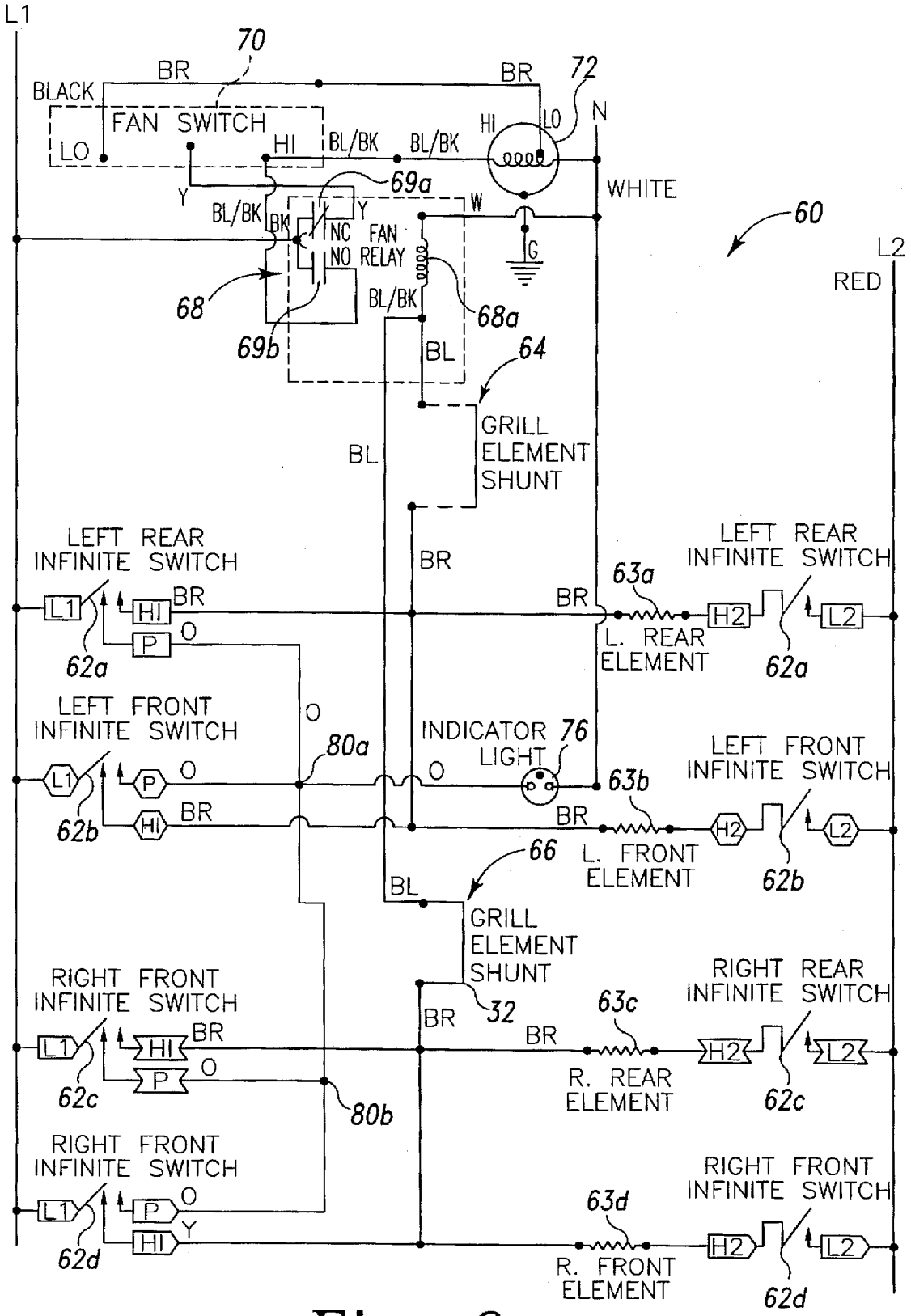
FIG. 6 is a schematic of the circuitry for controlling the fan speed in a cooktop.

FIG. 6 shows a schematic diagram for the electrical circuit 60 of a dual bay cooktop 10, such as shown in FIGS. 1 and 2. It will be appreciated that the circuit 60 can be readily adapted to serve any number of bays. The circuit 60 includes control switches 62*a* –62*d* for controlling the heating elements 63*a* –63*b* and positions for a plurality of shunts such as the left grill element shunt position 64 and the right grill element shunt position 66.

In operation, 120 VAC is continuously supplied from L1 to a switch 69*a* that is movable between a normally-closed position and an open position, and a switch 69*b* that is movable from a normally-open position to a closed position. In the normally-closed position, the L1 120 VAC is applied through the switch 69*a* to an input terminal of a fan control switch 70. Moving the fan control switch 70 from the off position to the low speed or high speed position sends L1 120 VAC to the low speed or high speed windings, respectively, of the fan motor 72. The fan control switch 70 is illustratively a three position switch, but it will be appreciated that other switching devices can be used instead.

For purposes of the following discussion, it is assumed that a grill element 22 is installed in the right bay 14 and a burner assembly (not shown) is installed in the left bay 16. In this configuration, a shunt 32 is located at the right grill element shunt position 66, but no shunt is present at the left grill element shunt position 64.

When either of the right side control switches 62*c*, 62*d* is switched on, the shunt 32 located at the right grill element shunt position 66 sends 120 VAC from L1, L2 to the coil 68*a* of the fan relay 68 which moves switch 69*a* from its normally-closed position to its open position, and moves switch 69*b* from its normally-open position to its closed position. Moving the switch 69*a* to the open position disconnects the fan switch 70 from line L1, and moving the switch 69*b* to its closed position connects the L1 120 VAC signal directly to the high speed terminal of the fan switch 70, effectively bypassing the fan switch 70. Thus, if the grill element 22 is installed in the cooktop 10 and either of the control switches 62*c*, 62*d* is on, the fan motor 72 is automatically operated at full speed. Moreover, by moving the switch 69*a* from the normally closed position, L1 120 VAC is removed from the input to the fan switch 70, thereby disabling the fan control switch 70 from energizing the motor windings. Thus, in the FIG. 6 configuration, relay coil 68*b* senses selection of operation of a grill unit 23 by control switches 62*c*, 62*d* through shunt 32 at the grill element shunt position 64, which provides a means for sensing the presence of a grill element in the cooktop, and the switches 69*a*, 69*b* of relay 68 automatically select high speed operation of the downdraft withdrawal fan 72 and bypass the fan control switch 70.

If a left side control switch 62*a*, 62*b* is switched on, the fan relay coil 68*a* remains electrically isolated by the absence of a shunt 32 at grill element shunt position 64. In normal operations, a burner assembly would not include a shunt 32, and the left side grill element shunt position 64 .is an open circuit. Thus, in the configuration illustrated in FIG. 6, the L1 120 VAC continues to be supplied to the input terminal of the fan switch 70 through the contact 69*a*, which remains in the normally-closed position, when only control switches 62*a* and 62*b* are operated.

An indicator light 76 is included to provide an indication to a cook that at least one of the control switches 62 is in the on position. When any of the control switches 62*a* –62*d* is switched on, L1 120 VAC is applied to the indicator light 76 via connection junctions 80*a*, 80*b*.

Although the invention has been described in detail with reference to a particular preferred embodiment, variations and modifications exist within the scope and spirit of the invention as described and defined in the following claims.

We claim:

1. In a method of withdrawing cooking vapor from adjacent a grill in which a grill operation is selectable and cooking vapor is withdrawn downwardly from adjacent the grill by a motor-driven fan operable at high and low rates of withdrawal selected by a multi-position electrical control switch, the improvement comprising:

sensing the selection of grill operation, and bypassing the electrical control switch and connecting the motor driven fan for operation at only a high rate of withdrawal of cooking vapors.

2. The method of claim 1 wherein upon sensing the selection of grill operation, the electrical control switch is rendered inoperative.

3. The method of claim 2 wherein upon sensing the de-selection of grill operation, the electrical control switch is rendered operative.

4. The method of claim 1 wherein the grill comprises an electrical grill element, and the improvement comprises sensing the presence of the grill element.

* * * * *